US005990397A

United States Patent [19]

Taylor

[11] Patent Number: 5,990,397

[45] Date of Patent: Nov. 23, 1999

[54] COLLAPSIBLE STRINGED MUSICAL INSTRUMENT

[76] Inventor: Shane Gregory Taylor, "Cooranga", Yetman New South Wales 2410, Australia

[21] Appl. No.: 09/209,081

[22] Filed: Dec. 10, 1998

[30] Foreign Application Priority Data

Dec. 18, 1997 [AU] Australia ..... PP 1068

[51] Int. Cl.[6] ..... G10D 3/00

[52] U.S. Cl. ..... 84/327; 84/267; 84/291

[58] Field of Search ..... 84/267, 291, 327

[56] References Cited

U.S. PATENT DOCUMENTS 4,770,079 9/1988 Mastroianni ..... 89/291

5,383,385 1/1995 Gilbert ..... 84/267

*Primary Examiner*—Robert E. Nappi
*Assistant Examiner*—Shih-yung Hsieh
*Attorney, Agent, or Firm*—Paul & Paul

[57] ABSTRACT

There is disclosed a stringed musical instrument of the type having a neck projecting from a body, and strings arranged alongside each other and extending along the neck and a face of the body in use. In one form, the instrument is provided with support means moveable from a retracted condition to an extended condition and incorporating a strap for providing support for a user or the instrument itself. In another form, the instrument is provided with at least one display plate moveable from a retracted position whereby a width of the instrument is minimized to an extended position to thereby increase the width of the instrument.

17 Claims, 5 Drawing Sheets

COLLAPSIBLE STRINGED MUSICAL INSTRUMENT

FIELD OF THE INVENTION

The present invention relates to a stringed musical instrument such as a guitar having components that are able to be moved to retracted positions following use to thereby minimise the dimensions of the instrument and so allow the instrument to be readily transported or stored away. The musical instrument of the invention finds particular use by travellers due to its collapsibility.

BACKGROUND OF THE INVENTION

Stringed musical instruments such as electric guitars by their very nature are bulky and difficult to transport. Indeed, during transportation or storage such guitars are commonly placed in hardened cases which due to their function requires them to be larger than the instrument they carry thereby exacerbating transportation and storage problems. The combined weight of the instrument and the case is also a disincentive for musicians to carry their guitar with them while travelling.

When travelling by aircraft or other modes of transportation such as road coach, musicians are often forced to check in their guitars as part of their luggage as it is usually not allowable for them to be carried on board the aircraft or coach with the musician. The need to check in guitars at airports also generally means that the instrument is counted as part of the weight allowance for the musicians luggage and indeed, may require the musician to pay excess luggage costs if the weight allowance is exceeded as a result. The collection of instruments at luggage carousels at the relevant destination is also time consuming and bothersome.

The bulkiness and weight of conventional guitars provides a particular problem for backpackers and like persons that generally travel with minimal luggage forcing many to leave their guitar behind as it is just too great a burden to take it with them. However, musicians commonly wish to have their guitars handy when travelling should the opportunity to play with other musicians arise or simply, so that they can play and work on any new tunes that may come to mind.

There is, therefore, a need for compact stringed musical instruments that are able to be readily transported and stored but which in use, can be handled in the same manner as conventionally known instruments.

U.S. Pat. No. 4,770,079 discloses a stringed instrument provided with a plurality of legs arranged on a rear face of the instrument's body. Each of the legs has a foot and is swingable outwardly from the body to provide support for the user. However, the body of the instrument is quite bulky due to the nature of the legs and their location. The legs are also unwieldy and visually, are not appealing.

In addition, as the positioning of the feet of the legs is variable it is necessary for each of the legs to be individually arranged in the desired position each time the instrument is to be used. Legs spaced apart from each other along the instrument also needs to be separately fixed in their desired positions. As such, the arrangement is also cumbersome and annoying to use.

SUMMARY OF THE INVENTION

It is an aim of the present invention to at least provide users of stringed musical instruments with an instrument suitable for being carried with them while travelling and which can be readily stored when not in use.

In a first aspect of the invention there is provided a stringed musical instrument of the type having a neck projecting from a body, and strings arranged alongside each other and extending along the neck and a face of the body in use, the instrument further comprising:

support means moveable from a retracted condition to an extended condition in a direction away from the instrument, and incorporating a strap for providing support for a user or the instrument itself, wherein the strap is able to at least partially conform to an outer contour of a body part of the user and is held from the body so as to extend alongside a peripheral region of same and thereby provide said support, when the support means is in the extended condition.

The support means will generally also comprise a pair of arms distanced apart from each other and each having a proximal end region and an opposite distal end region wherein the strap extends between and is carried by the distal end regions of the arms, the arms being moveable relative to the body of the instrument to allow the belt to be held therefrom.

Typically, the instrument will be provided with a further pair of arms for holding the strap from an opposite region of the body of the instrument to that from which the strap is held by the first pair of arms.

Each of the arms will usually lie in a lengthwise direction along the instrument when in their retracted positions and usually, will be swung in an outward direction to thereby distance the belt from the body when the instrument is to be used.

There is also described a stringed musical instrument of the type having a neck projecting from a body, and strings being arranged alongside each other and extending along the neck in a face of the body in use. The instrument further comprises at least one display plate having a front face and an opposite rear face, and being moveable from a retracted condition whereby the width of the instrument is minimised to an extended condition to thereby increase the width of the instrument. The display plate has a desired profile and is arranged so as to project from and extend alongside the body such that the front face is orientated generally in the same direction as the face of the body, when the display plate is in the extended condition.

Preferably, the front face of the display plate and the face of the body of the instrument arc substantially level when the display plate is in the extended condition.

Most preferably, the instrument will be provided with a plurality of such display plates. In a particularly desirable embodiment the instrument will have two display plates, one being arranged each side of the body of the instrument respectively.

The or each display plate may be of a length substantially equal to or greater in length than the body of the instrument.

When in the extended condition, the display plate or plates give the impression that the instrument's body is larger than is actually the case thereby making the instrument more desirable to a potential user. If desired, the display plate(s) may have the profile of the body of a conventionally known instrument and so further enhance the appeal of the instrument to the user. Moreover, they can provide support for the user, generally a user's hand, when the instrument is being played.

In addition, there is described herein a stringed instrument of the type having a neck projecting from a body, and strings arranged alongside each other and extending along the neck and a face of the body in use. More particularly, the strings extend substantially the entire length of the instrument and are fixed to the neck at or immediately adjacent a front end of the neck, and wrap around a rear end of the instrument to terminate at termination means. The termination means will generally be able to tension of the strings individually.

By arranging the strings in such a way the length of the instrument can be decreased which is particularly desirable for travellers.

The invention will now be described hereinafter with reference to a number of preferred embodiments illustrated in the accompanying drawings.

BRIEF DESCRIPTION OF THE ACCOMPANYING DRAWINGS

DETAILED DESCRIPTION OF PREFERRED EMBODIMENTS OF THE INVENTION

Figure 1:
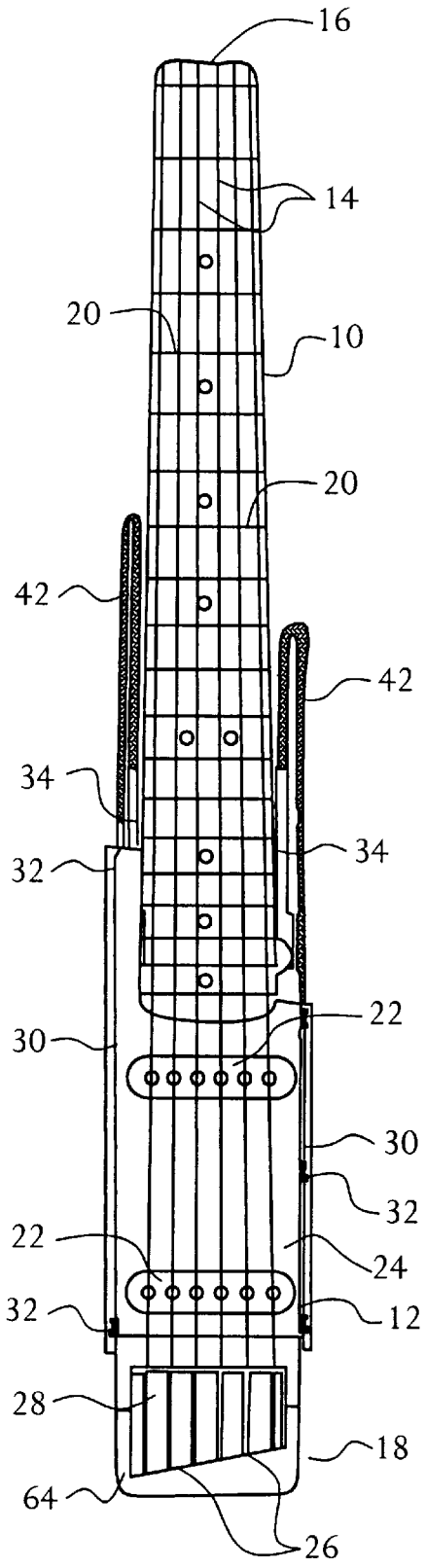
FIG. 1 is an embodiment of a stringed musical instrument of the invention.

The guitar shown in FIG. 1 comprises a neck 10 extending from a body 12 along which tensioned strings 14 extend from the front end 16 of the guitar to a rear end 18.

A plurality of frets 20 are located along the neck and pick ups 22 are arranged across face plate 24 of the body 12. As can be seen, strings 14 pass over the pick ups and wrap around string rollers 26 located on bridge 28 at the rear end 18 of the guitar. The body 12 houses electronic circuitry for amplifying signals from the pick ups and has outlet ports for transmission of the amplified signals from the guitar as is commonly known.

Display plates 30 in the form of flaps are folded against opposite sides of the guitar and are connected to face plate 24 through hinges 32. In their retracted position as shown the display plates lie substantially perpendicularly with respect to the face plate of body 12. Moreover, the display plates 30 cover neck arms 34 that are also folded along the respective sides of the guitar and which are able to pivot with respect to the body 12 through hinges 36. The width of the display plates 30 is such that they do not project beyond the underside face of the guitar's body.

Figure 2:
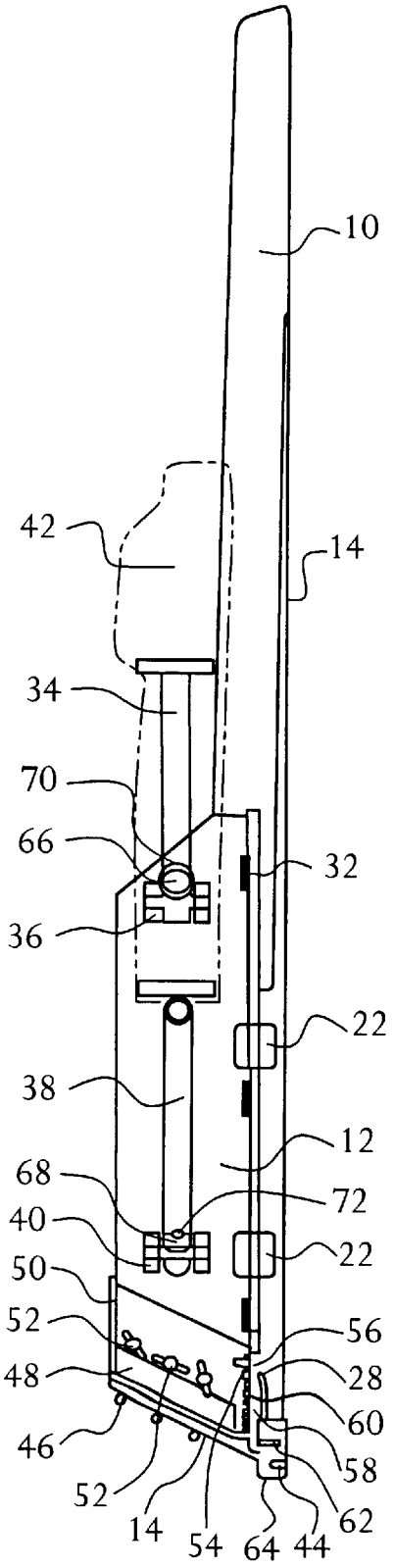
FIG. 2 is a side view of the musical instrument of FIG. 1.

As indicated in FIG. 2 in which the relevant display plate 30 is not shown, a bridge arm 38 is located rearwardly of the neck arm that again, is pivotaly attached to body 12 through hinge 40. Another bridge arm is located on the opposite side of the body in a corresponding position. Strap sections 42 are attached at one of their ends to a bridge arm 38 and at opposite ends to the associated neck arm 34.

The strings are fixed substantially at the front end of the guitar and extend along the neck in a side by side relationship. FIG. 2 also shows that after wrapping around string rollers 44, the strings 14 are received by termination means in the form of string capstans 46, each string capstan receiving one string respectively. The string capstans are mounted on tuning block 48 which is supported under bridge 28 by tuning block support 50. As will be understood, the string capstans 46 can be rotated by the operation of tuning keys 52 to thereby tension strings 14 as desired.

The tang 54 of bridge 28 extends through aperture 56 of bridge support plate 58 allowing the bridge to be inclined rearwardly relative to bridge support plate 58 by adjusting the screws 60 and 62. In order to protect the strings 14 and string rollers 44, a bridge guard 64 extends around the bridge 28.

Figure 3:
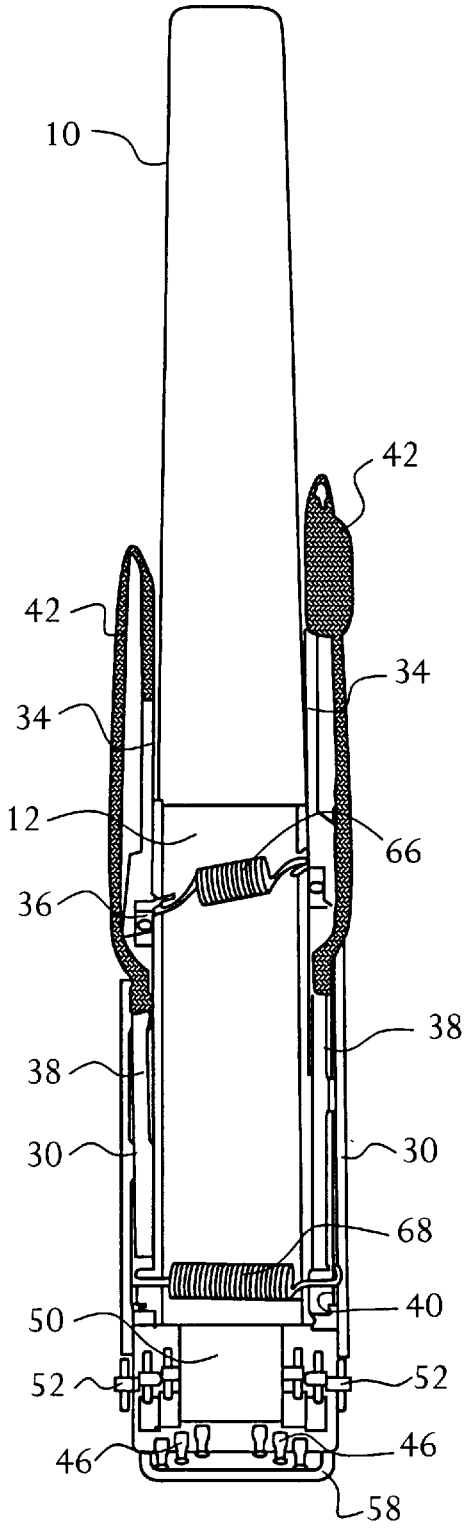
FIG. 3 is a bottom view of the musical instrument of FIG. 1.

The positions of neck arms 34 and bridge arms 38 along the sides of the guitar are more clearly shown in FIG. 3. The arms are held against the guitar under the tension of springs 66 and 68 which extend across the body 12 and hook onto the respective arms through apertures 70 and 72 of the body.

When the neck arms 34, bridge arms 38 and the display plates 30 are folded alongside the body 12 in their retracted positions, the width and hence bulk of the guitar is minimised. As the neck arms 34 and bridge arms 38 are located under the display plates 30, they as well as the body 12 are further protected from damage.

The length of the guitar has also been minimised by positioning the string capstans under the bridge 28. At the same time, however, the length of the strings has been maximised by arranging them such that they extend along substantially the entire length of the guitar. Minimising the dimensions is particularly advantageous for travellers as the guitar can be kept with them as part of their hand luggage on aircraft or other modes of transport which is generally not possible with conventional guitars due to their bulk.

Figure 4:
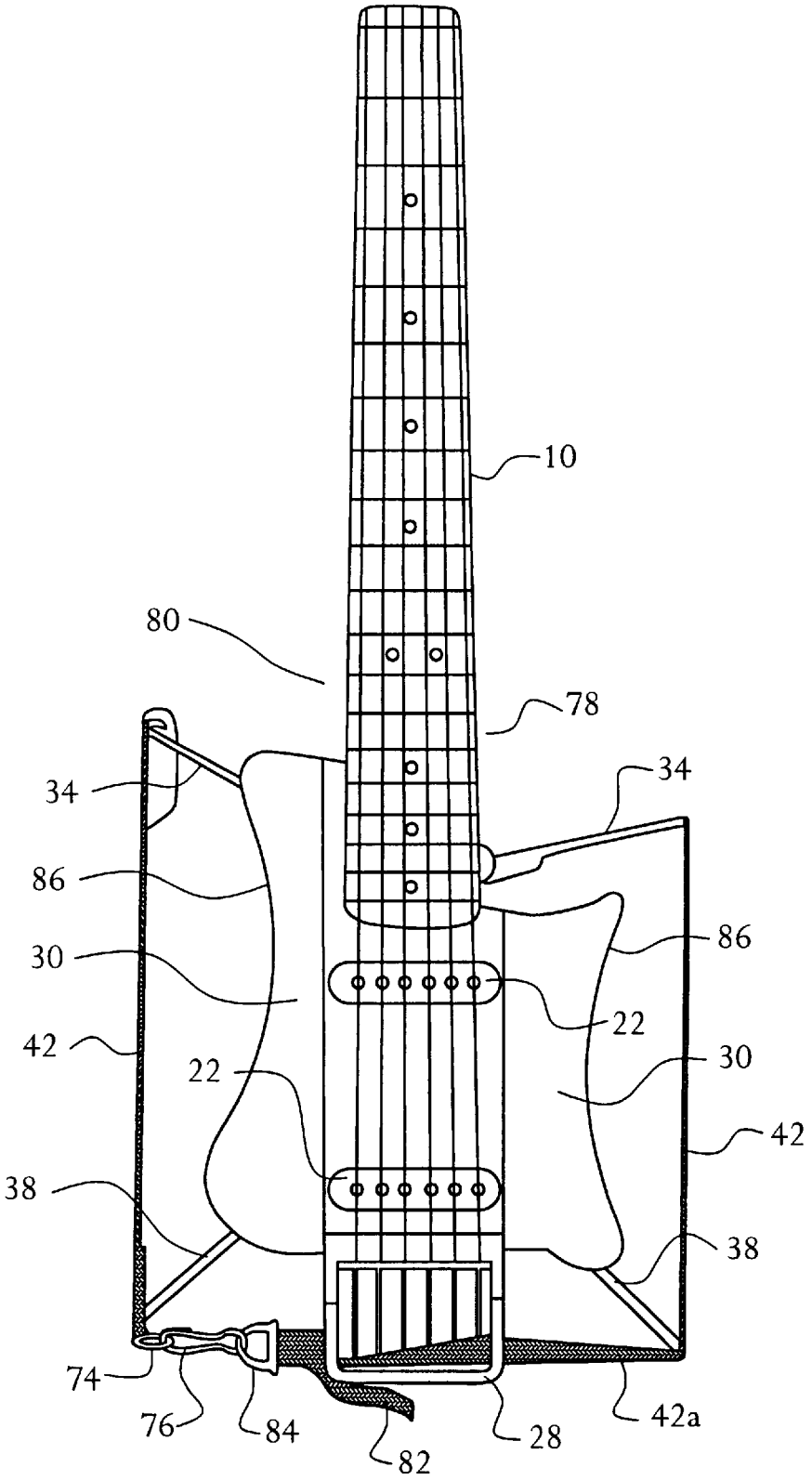
FIG. 4 is a plan view of the musical instrument of FIG. 1 showing the musical instrument of FIG. 1 when in use.

FIG. 4 shows the neck and bridge arms in their extended position when the guitar is to be used. More specifically, neck arms 34 extend outwardly and forwardly from body 12 while bridge arms 38 extend outwardly and rearwardly with respect to the body. The arms are maintained in this configuration by the receipt of loop 74 by catch 76 of the strap 42. Moving the arms to their extended positions is simply a matter of pivoting them about their respective hinges as will be readily appreciated.

The sections of the strap 42 connecting the bridge and neck arms on side 78 of the guitar rests on the users leg and so acts as a support for the guitar while the other strap section 42 connecting the bridge and neck arms on the opposite side 80 supports the upper body or arm of the user. The strap region 42*a* extending between the bridge arms may also be used as a leg rest.

In use, the strap 42 conforms to the contour of the relevant part of the users body it presses against which not only provides comfort for the user but also allows the guitar to be firmly located in position to suit the users requirements. Moreover, since the strap 42 is continuous between the neck and bridge arms, it provides support along its entire length. The tension of the strap can be altered by drawing or releasing strap end 82 through adjustment buckle 84.

Figure 5:
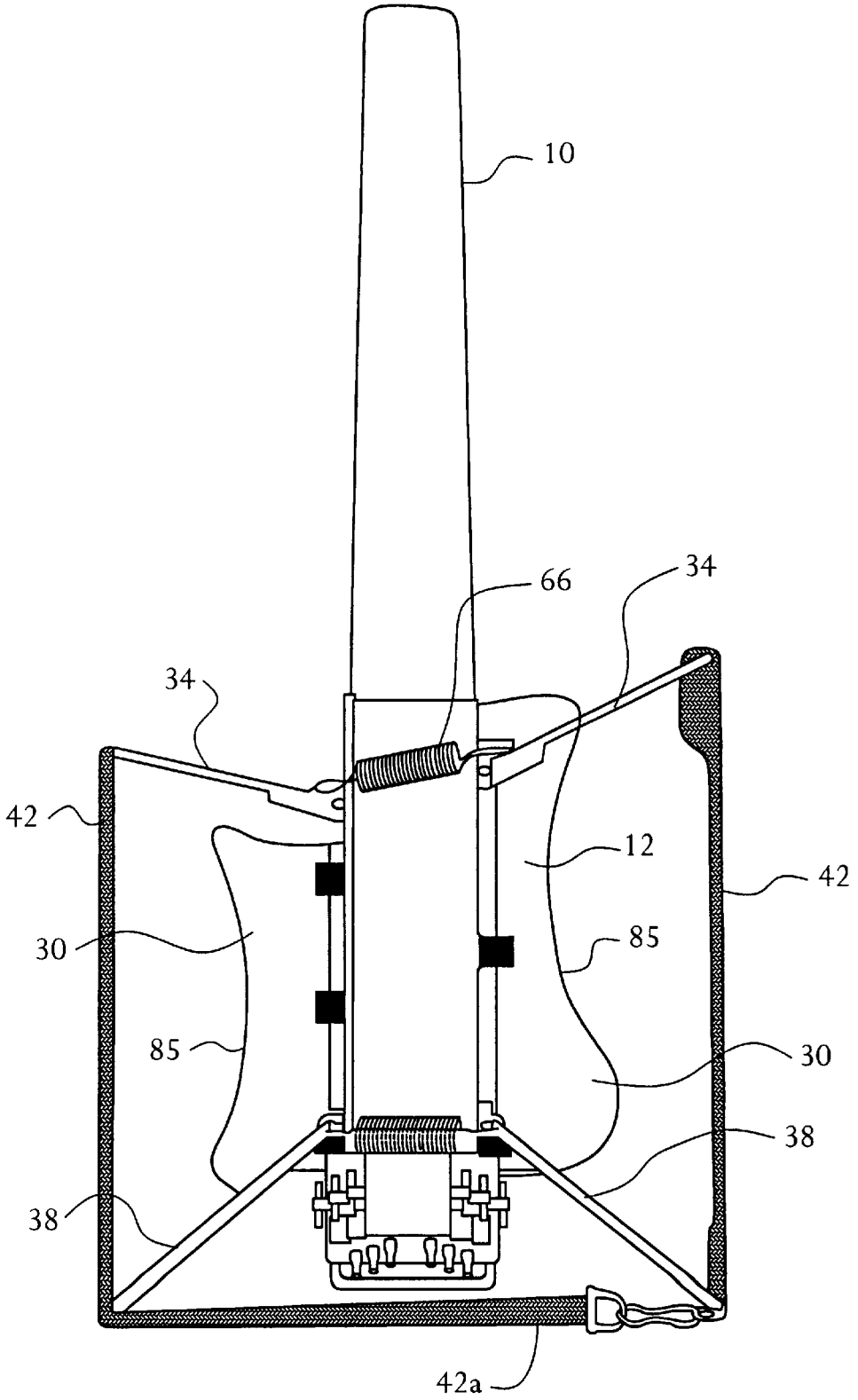
FIG. 5 is a bottom view of the instrument of FIG. 4.

As shown in FIG. 5, the neck arms 34 are prevented from collapsing to their retracted positions by the engagement of spring 66 with leading sides thereof. That is, spring 66 acts to draw the neck arms toward the neck in opposition to the tension provided by strap 42. In another embodiment, springs 66 and 68 may be omitted and hinges used that are able to be locked such that the neck and bridge arms are fixed in their extended positions. In this instance, strap portion 42*a* extending between bridge arms 38 may not be present.

The front faces of display plates 30 lie substantially level with the face plate 24 of the guitar when the display plates are in their extended positions and so provide with the face plate a generally planar surface extending across the guitar. The display plates when extended also provide the impression that the body of the guitar has a significantly greater width then is actually the case and so gives the guitar a more conventional appearance. Advantageously, the display plates have a profile 85 imitating that of a conventional guitar.

The display plates 30 are maintained in their extended position under the action of hinges 32. Returning the display plates to their retracted positions is achieved by applying sufficient force to overcome the resistance provided by the hinges 32. In order to protect against inadvertent retraction of the display plates any suitable device for locking the display plates in position may be used.

If desired, the guitar may be adapted to receive a leg rest attachment on its rear end. Alternatively, the guitar may be provided with a leg rest able to be drawn rearwardly from the body 12 or which is able to be swung into an extended position from a retracted position alongside the body of the guitar.

In addition, the neck and bridge arms 34 and 38 may be telescopically extendible from within the interior of the body rather than being arranged alongside the body 12 when in their retracted position as shown in the accompanying drawings.

Accordingly, although the present invention has been described hereinbefore with reference to a number of preferred embodiments, the skilled addressee will appreciate that numerous variations and modifications are possible without departing from the scope of the invention.

The claims defining the invention are as follows:

1. A stringed musical instrument of the type having a neck projecting from a body, and strings arranged alongside each other and extending along the neck and a face of the body in use, the instrument further comprising:

support means moveable from a retracted condition to an extended condition in a direction away from the instrument, and incorporating a strap for providing support for a user and the instrument itself;

wherein the strap is able to at least partially conform to an outer contour of a body part of the user and is held from the body so as to extend alongside a peripheral region of same and thereby provide said support, when the support means is in the extended condition.

2. A stringed musical instrument according to claim 1 wherein the support means further comprises:

a first pair of arms distanced apart from each other and each having a proximal end region and an opposite distal end region;

wherein the strap extends between and is carried by the distal end regions of the arms, and the arms are moveable relative to the body of the instrument to allow the belt to be held from the peripheral region of the body.

3. A stringed musical instrument according to claim 2 wherein the support means further comprises:

a second pair of arms distanced apart from each other and each having a proximal end region, and an opposite distal end region for holding the strap from an opposite peripheral region of the body of the instrument to that from which the strap is held by the first pair of arms; and wherein the second set of arms are moveable relative to the body to thereby enable the strap to be held from said opposite peripheral region of the body when the support means is in the extended condition.

4. A stringed musical instrument according to claim 3 where in the strap is in two sections one of which is supported by the first pair of arms and the other of which is supported by the second pair of arms, and wherein the sections of the strap are connectable to each other and are able to be tensioned.

5. A stringed musical instrument according to claim 4 wherein at least one of the arms of each said pair of arms is maintained in position by tension of the strap when the support means is in the extended condition.

6. A stringed musical instrument according to claim 3 wherein the neck of the instrument extends from a forward region of the body and one of the arms of each of the first and second said pairs of arms is connected to the neck, and the other said arm of each said pair of arms is connected to a rear region of the body.

7. A stringed musical instrument according to claim 6 wherein the one said arm of each of the pair of arms is arranged to lie alongside the neck and the other arm of each said pair of arms is arranged to lie alongside the body, when the support means is in the retracted condition.

8. A stringed musical instrument according to claim 1 wherein each said arm is arranged to be pivoted from a retracted position to an extended position to thereby enable the strap to be held from the body of the instrument.

9. A stringed musical instrument according to claim 1 wherein the strap extends for substantially the entire length of the body when the support means is in the extended condition.

10. A stringed musical instrument of the type having a neck projecting for a body, and strings arranged alongside each other and extending along the neck and a face of the body in use, the instrument further comprising:

at least one display plate having a front face and an opposite rear face, and being moveable from a retracted position whereby width of the instrument is minimized to an extended position to thereby increase the width of the instrument;

wherein the display plate has a desired profile and is arranged alongside the body such that the front face is orientated generally in the same direction as the face of the body, when the display plate is in the extended position.

11. A stringed musical instrument according to claim 10 wherein the rear face of the display plate is arranged immediately adjacent to the body when the display plate is in the retracted condition.

12. A stringed musical instrument according to claim 10 wherein the front face of the display plate and the face of the body are substantially level when the display plate is in the extended condition.

13. A stringed musical instrument according to claim 10 wherein the front face of the display plate when in the retracted condition lies substantially perpendicularly relative to when the display plate is in the extended condition.

14. A stringed musical instrument according to claim 10 wherein the instrument has more than one said display plate and the body of the instrument has a first side and an opposite second side, at least one said display plate being arranged each side of the body, respectively.

15. A stringed musical instrument according to claim 10 having two said display plates, one being arranged each side of the body of the instrument respectively.

16. A stringed musical instrument according to claim 15 wherein each said display plate is of a length substantially equal to or greater in length than the body of the instrument.

17. A stringed musical instrument according to claim 10 wherein said display plate is pivotable from the retracted condition to the extended condition about an axis of rotation that extends in a lengthwise direction along the instrument, respectively.

* * * * *